US007338630B2

(12) United States Patent
Kano et al.

(10) Patent No.: US 7,338,630 B2
(45) Date of Patent: Mar. 4, 2008

(54) FREE-CUTTING STEEL AND FUEL INJECTION SYSTEM COMPONENT USING THE SAME

(75) Inventors: Takashi Kano, Nagoya (JP); Yasuhiro Hazama, Tokai (JP); Junya Asaoka, Kariya (JP); Masaki Shimizu, Kariya (JP); Katsumi Mori, Kariya (JP); Hisashi Endo, Kariya (JP)

(73) Assignees: Daido Tokushuko Kabushiki Kaisha, Nagoya (JP); DENSO Corporation, Kariya (JP)

( * ) Notice: Subject to any disclaimer, the term of this patent is extended or adjusted under 35 U.S.C. 154(b) by 479 days.

(21) Appl. No.: 10/963,492

(22) Filed: Oct. 11, 2004

(65) Prior Publication Data

US 2005/0089437 A1 Apr. 28, 2005

(30) Foreign Application Priority Data

Oct. 28, 2003 (JP) ..... 2003-367048
Apr. 14, 2004 (JP) ..... 2004-119532

(51) Int. Cl.
*C22C 38/02* (2006.01)
*C22C 38/04* (2006.01)
*C22C 38/06* (2006.01)
*C22C 38/14* (2006.01)

(52) U.S. Cl. ..... 420/84; 420/85; 420/129; 420/128; 420/126

(58) Field of Classification Search ..... 420/84–85, 420/104–129; 148/320, 326; 75/507
See application file for complete search history.

(56) References Cited

U.S. PATENT DOCUMENTS

| | | | | |
|---|---|---|---|---|
| 5,922,145 | A | 7/1999 | Watari et al. | |
| 6,036,790 | A * | 3/2000 | Takada et al. | 148/320 |
| 6,143,242 | A * | 11/2000 | Takada et al. | 420/87 |
| 6,454,881 | B1 * | 9/2002 | Hase et al. | 148/332 |
| 6,838,048 | B2 * | 1/2005 | Nishi et al. | 420/84 |

FOREIGN PATENT DOCUMENTS

| | | |
|---|---|---|
| EP | 0 312 054 | 4/1989 |
| EP | 1 316 624 | 6/2003 |
| JP | 2000-265243 | 9/2000 |
| JP | 2003-064412 | 3/2003 |

* cited by examiner

*Primary Examiner*—Deborah Yee
(74) *Attorney, Agent, or Firm*—Harness, Dickey & Pierce, PLC

(57) ABSTRACT

The present invention is to provide a free-cutting steel capable of suppressing production of coarse inclusions, and having a high fatigue strength and a desirable machinability. The free-cutting steel aimed at solving the foregoing problems consists essentially of, in % by mass, C: 0.1-0.5%, Si: 0.05-2.5%, Mn: 0.1-3.5%, S: 0.0005-0.004%, Al: 0.01-0.06%, Ti: 0.003-0.01%, O: up to 0.0015%, N: 0.003-0.01%, Bi: 0.015-0.025%, and the balance of Fe and inevitable impurities, wherein the formula (1) below is satisfied:

$$-4.8 \leqq \log(([N]-0.0015)\times[Ti]^{0.98}) \leqq -4.3. \quad \text{formula (1)}$$

10 Claims, 8 Drawing Sheets

METAL Bi INCLUSION

MnS + METAL Bi INCLUSION

FREE-CUTTING STEEL AND FUEL INJECTION SYSTEM COMPONENT USING THE SAME

BACKGROUND OF THE INVENTION

1. Field of the Invention

This invention relates to a free-cutting steel and a fuel injection system component using the same.

2. Description of the Related Art

Pb-containing, free-cutting steel has widely been used in fields where an excellent free-cuttability is required. This sort of highly toxic machinability-improving element such as Pb is, however, becoming more strictly regulated from the recent environmental viewpoint, and efforts for searching substitute steel are becoming more active. Bi has been known as one hopeful machinability-improving element substitutable for Pb. Another known substitutive material is exemplified by a material using S as a major component of the machinability-improving element. The material is aimed at producing an inclusion which mainly comprises an MnS-base compound, and thereby raising machinability and grindability through enhancing stress concentration effect on the inclusion in the process of forming cutting chips and lubricating action between a machine tool and the chips.

On the other hand, there is a strong need for high-fatigue-strength steel in recent trends in weight reduction, down-sizing, and performance upgrading of mechanical structures and various components such as vehicle components. Under fatigue stress exerted on steel in a fatigue environment, any defects such as inclusion in the texture will cause concentration of the fatigue stress, and fatigue failure of the internal-failure-type will occur as being initiated from the defects. It is therefore necessary to control size and content of the inclusion in the texture, as described in Japanese Laid-Open Patent Publication No. 2003-64412.

The free-cutting steel in which use of the inclusion is welcomed in view of imparting a desirable machinability, and the high-fatigue-strength steel in which the inclusion is not welcomed in view of imparting a high fatigue strength are contradictory with each other in concept of the inclusion. It has, therefore, been extremely difficult to realize a free-cutting steel having a high fatigue strength.

One specific field of application is exemplified by a fuel injection system component. For the fuel injection system, there is a growing demand on increase in the fuel injection pressure in order to meet the emission control law which is becoming more stringent year by year. Any components used in this sort of system will therefore be applied with a larger repetitive stress, so that it is necessary for the component to have a high fatigue strength, and at the same time, a desirable machinability in view of reducing the process costs.

It is therefore an object of the present invention to provide a free-cutting steel capable of suppressing production of coarse inclusions, and having a high fatigue strength and a desirable machinability, and also to provide a fuel injection system component using the same.

SUMMARY OF THE INVENTION

A free-cutting steel of the present invention aimed at solving the above-described problems consists essentially of, in % by mass, C: 0.1-0.5%, Si: 0.05-2.5%, Mn: 0.1-3.5%, S: 0.0005-0.004%, Al: 0.01-0.06%, Ti: 0.003-0.01%, O: up to 0.0015%, N: 0.003-0.01%, Bi: 0.015-0.025%, and the balance of Fe and inevitable impurities, wherein the formula (1) below is satisfied:

$$-4.8 \leqq \log(([N]-0.0015)\times[Ti]^{0.98}) \geqq -4.3 \qquad \text{formula (1).}$$

In high-fatigue-strength steel (typically having a hardness Hv of 300 or above), an inclusion having an extreme size, out of all inclusions reside in the steel texture, tends to serve as an initiation point of the fatigue failure, wherein even a smaller inclusion can act as an initiation point of the fatigue failure as the fatigue strength becomes larger, so that it is necessary to reduce the size of extreme-sized inclusion to possibly obstruct realization of high fatigue strength. As described in the above, size of the extreme-sized inclusion, rather than amount (inclusion producing element) thereof, is of a larger importance. In view of achieving both of high fatigue strength and machinability at the same time, it is therefore necessary to reduce as much as possible generation of coarse inclusion, and to promote as much as possible formation of fine inclusion.

The free-cutting steel of the present invention has Bi and S added thereto as the inclusion producing elements. In the steel texture, Bi aggregates to thereby produce a Bi metal inclusion, and S mainly binds with Mn to thereby produce a sulfide-base inclusion. The steel texture added only with Bi as the inclusion producing element will generate therein coarse Bi metal inclusion in an aggregated manner, and will degrade the fatigue strength. On the other hand, it has been known that addition of S as an inclusion producing element, together with Bi, results in aggregation of Bi around the sulfide-base inclusion. The present inventors found out that dispersion of a sulfide-base inclusion to an appropriate amount with respect to Bi content was successful in preventing Bi, which possibly aggregates around the sulfide-base inclusion, from growing into coarse grains, and in suppressing generation of a coarse Bi metal inclusion as a single entity. In other words, the present inventors obtained a finding that the Bi metal inclusion could be minimized by controlling dispersion of the sulfide-base inclusion to thereby suppress the aggregation of Bi.

FIGS. 5A and 5B show sectional SEM images of the free-cutting steel of the present invention, and a steel added only with Bi as the inclusion producing element, respectively. It can be seen in the drawings that FIG. 5B shows a coarse Bi metal inclusion produced in an aggregated manner, whereas the free-cutting steel of the present invention shown in FIG. 5A produces a composite inclusion in which the sulfide-base inclusion and the Bi metal inclusion are hybridized (in further detail, a composite inclusion comprising the sulfide-base inclusion and Bi aggregated in the boundary thereof), the sulfide-base inclusion as a single entity, and the Bi metal compound as a single entity, all of which having small sizes.

As the preceding paragraphs suggest, the sulfide-base inclusion have an effect of suppressing aggregation of Bi, whereas the sulfide-base inclusion per se tends to grow into larger grains. In the present invention, amount of addition of S is limited in order to micronize the sulfide-base inclusion, and at the same time, a trace amount of Ti is added. The present inventors brought a generation mechanism of the sulfide-base inclusion into our focus, and reached an idea of controlling the size to a smaller one, by producing fine nuclei typically composed of such as TiN first in a process of solidification of the molten steel, and then by allowing MnS to deposit around the nuclei. This makes the coarse sulfide-base inclusion less likely to generate, and makes it possible to produce a large amount of fine sulfide-base inclusion in the texture. Because the fine sulfide-base inclusion can make also the Bi metal inclusion fine, all inclusions reside in the steel texture become fine.

The following paragraphs will describe reasons for limitation on the composition in the present invention.

C (Carbon): 0.1-0.5%

C is added for the purpose of improving strength of the steel. The C content less than 0.1% may result in an insufficient strength of the steel. On the other hand, the C content exceeding 0.5% may result in an excessively increased hardness of the steel, and consequently in a degraded machinability. The C content is more preferably in a range from 0.1 to 0.4%. For the case where a greater account is made on the strength, the C content is preferably in a range from 0.32 to 0.39%. On the other hand, for the case where a greater account is made on the tensile strength, the C content is preferably in a range from 0.12 to 0.18%.

Si (Silicon): 0.05-2.5%

Si can be contained as a deoxidizer. This is also an element effective as a solid-solution-strengthening element for improving strength of the steel. The content must be 0.05% in order to obtain this effect, where an excessive content increases hardness of the steel and degrades the machinability. The amount of addition of Si is therefore preferably 0.15% or above. Because deoxidization control in the present invention is assigned essentially to Al, the Si content is preferably set to 2.5% or less in view of improving the machinability. The Si content is more preferably set to 1.0% or less, and still more preferably 0.35% or less.

Mn (Manganese): 0.1-3.5%

Mn binds with S to produce the sulfide-base inclusion, to thereby contribute to improvement in the machinability. The Mn content less than 0.1% or less may result in formation of FeS, and thereby the hot workability may degrade. The amount of addition of Mn is more preferably set to 0.55% or above. The content exceeding 3.5% may, however, increase hardness of the steel, and may consequently degrade the machinability. The amount of addition of Mn is more preferably set to 2.0% or less, and still more preferably 0.90% or less.

S (Sulfur): 0.0005-0.004%

S binds with Mn to produce the sulfide-base inclusion, to thereby contribute to improvement in the machinability. As described in the above, the sulfide-base inclusion has an effect of preventing Bi aggregation and growing into coarse grains. Balance between the amounts of production of the Bi metal inclusion and sulfide-base inclusion is an essential issue for obtaining this effect, wherein in the present invention, the S content must be 0.0005% or above. On the other hand, it is necessary to suppress the S content to as low as 0.004% or less in order to micronize the sulfide-base inclusion produced in the steel texture. The amount of addition of S is preferably set to 0.003% or less. More specific description on the size of the inclusion will be given later.

Al (Aluminum): 0.01-0.06%

Al can be contained as a deoxidizer. Al should be added in an amount of 0.01% or more in order to eliminate any oxide-base inclusion in a form of $Al_2O_3$. An excessive content of Al may, however, result in increase in the secondary deoxidization products, so that the upper limit of the content is preferably set to 0.06%.

Ti (Titanium): 0.003-0.01%

Ti produces TiN. TiN can serve as generation sites of non-uniform nuclei of the sulfide-base inclusion, so that micro-dispersion of TiN is advantageous in the micro-dispersion of the sulfide-base inclusion, and consequently in preventing Bi from aggregating and coarsening. The Ti content must be 0.003% or above in order to obtain this effect, and still more preferably 0.005% or above. An excessive content may, however, result in coarsening of TiN, and may consequently degrade the fatigue strength, so that the upper limit of the content is preferably set to 0.01%. The Ti content is more preferably set in a range from 0.005 to 0.008%.

O (Oxygen): up to 0.0015%

O is contained in the molten steel, and is inevitably contained in the steel. An excessive content thereof may increase the amount of oxide-base inclusion, so that the upper limit is set to 0.0015%.

N (Nitrogen): 0.003% to 0.01%

N produces TiN and AlN. TiN is necessary to micronize the sulfide-base inclusion as described in the above, and AlN is necessary to prevent the crystal grain size from coarsening during carburization. N should be added in an amount of 0.003% or above in order to obtain this effect. An excessive content of N may coarsen TiN and AlN, and may consequently degrade the fatigue strength, so that the upper limit of the content is preferably set to 0.01%. The N content is more preferably set in a range from 0.004 to 0.008%.

Bi (Bismuth): 0.015% to 0.025%

Bi is added for the purpose of improving the machinability. Addition in an amount of 0.015% or above is necessary in order to improve the drilling property. An excessive content may coarsen the Bi metal inclusion, and may consequently degrade the fatigue strength, so that the upper limit of the content is preferably set to 0.025%.

$$-4.8 \leqq \log(([N]-0.0015)\times[Ti]^{0.98}) \leqq -4.3 \qquad \text{formula (1)}$$

※ see FIG. 1

The present invention uses TiN as nuclei for growing fine sulfide-base inclusion. The formula (1) specifies [Ti] and [N] for allowing production of fine TiN which serve as the nuclei of the sulfide-base inclusion, It is to be noted herein that [ ] expresses content (% by mass) of an element given therein. It is also to be noted that [Ti] and [N] are corrected as ([N]−0.0015) and $[Ti]^{0.98}$, respectively, based on an empirical rule on the production of TiN.

In order to produce the fine TiN in an amount necessary for generating the nuclei of the sulfide-base inclusion, a value of $\log(([N]-0.0015)\times[Ti]^{0.98})$ must be −4.8 or above. The value smaller than −4.8 may stabilize Ti and N in a solubilized manner, and may fail in producing TiN. On the other hand, too large value of $\log(([N]-0.0015)\times[Ti]^{0.98})$ may coarsen the resultant TiN, and may consequently degrade the fatigue strength. The upper limit is therefore set to −4.3. This makes it possible to suppress the generation of coarse TiN.

A region which satisfies the aforementioned formula (1) appears in a band form as shown in FIG. 1. In this band-formed region (concentration environment), TiN is produced in an appropriate size. The sulfide-base inclusion grown around the TiN nuclei is therefore micronized, so that also the Bi metal inclusion is micronized.

In the free-cutting steel of the present invention, it is preferable that, these inclusions reside in the steel texture:

the composite inclusion, in which a sulfide-base inclusion and a Bi metal inclusion are hybridized, has a maximum diameter $\sqrt{AREAmax}$ (MnS+Bi), estimated by the extreme value statistics, of 25 μm or less;

the sulfide-base inclusion as a single entity has a maximum diameter $\sqrt{}$AREAmax (MnS), estimated by the extreme value statistics, of 20 μm or less; and the Bi metal inclusion as a single entity has a maximum diameter $\sqrt{}$AREAmax (Bi), estimated by the extreme value statistics, of 20 μm or less.

The extreme value statistics is a technique of estimating size $\sqrt{}$AREAmax of the largest inclusion which resides in an arbitrary area, by measuring, on a plurality of test pieces, sizes of the largest inclusions out of those that reside in a certain unit area, and by plotting the measured values on an extreme value population sheet. As described in the above, the steel texture of the free-cutting steel of the present invention has essentially three types of inclusions that reside therein; which are the sulfide-base inclusion as a single entity, Bi metal inclusion as a single entity, and composite inclusion of these; the fatigue strength depends on the size of these extreme-sized inclusions. A desirable fatigue strength can therefore be realized by specifying the sizes $\sqrt{}$AREAmax of the individual extreme-sized inclusions as 25 μm or less for $\sqrt{}$AREAmax (MnS+Bi), 20 μm or less for $\sqrt{}$AREAmax (MnS), and 20 μm or less for $\sqrt{}$AREAmax (Bi).

The free-cutting steel of the present invention can further contain one or both of Cr: up to 3.5%, and Mo: up to 2%. These elements can appropriately embrittle the steel matrix, and discontinues cutting chips generated during the cutting, and suppresses formation of a bird-nest-like continuous cutting chips. Addition of these elements in amounts exceeding the individual upper limits may excessively harden the matrix, and may undesirably degrade the machinability. The amount of addition of Cr is more preferably set to 2.0% or less, and still more preferably 1.25% or less. The amount of addition of Mo is more preferably set to 1.0% or less, and still more preferably 0.35% or less. On the other hand, the amount of addition of Cr is preferably adjusted to 0.85% or above, and Mo to 0.15% or above for the case where these elements are intentionally added.

For the purpose of manufacturing the above-described, free-cutting steel, a method of manufacturing the free-cutting steel of the present invention carries out a Ti addition step for adding Ti, and a Bi addition step for adding Bi, in this order, while keeping N concentration in a molten steel at 100 ppm or below. More specifically, the Ti addition step carried out while keeping N concentration in a molten steel at 100 ppm or below makes it possible to produce fine nuclei composed of TiN or the like, and to allow the fine sulfide-base inclusion to deposit around the nuclei. The next Bi addition step, carried out in a state where the fine sulfide-base inclusion has already produced, is successful in micronizing also the Bi metal inclusion. This makes it possible to control reduction in size of the sulfide-base inclusion and Bi metal inclusion, as described in above. The N concentration in the molten metal herein is more preferably adjusted to 80 ppm or below.

The Bi addition step is preferably carried out so as to add Bi at a rate of addition of 0.05 kg per minute and per ton of molten steel to 0.20 kg per minute and per ton of molten steel, both ends inclusive. Bi floats on the molten metal rather than being dissolved therein, so that it is preferably added in the final stage of the refinement process. A too small rate of addition in this case may degrade an yield of Bi due to flotation or evaporation thereof, so that the lower limit is preferably set to 0.05 kg per minute and per ton of molten steel, and more preferably to 0.07 kg per minute and per ton of molten steel. On the other hand, a too fast rate of addition may cause reaction of Bi with the pan made of a refractory material at the bottom thereof or stagnation of Bi, and may again degrade the yield of Bi, so that the upper limit is preferably set to 0.20 kg per minute and per ton of molten steel, and more preferably to 0.18 kg per minute and per ton of molten steel.

The free-cutting steel of the present invention described in the above is preferably used as a fuel injection system component. The free-cutting steel of the present invention has both of a high fatigue strength and a desirable machinability satisfied at the same time as described in the above, capable of resisting against large stress repetitively applied thereto, capable of reducing the machining cost, and can preferably be applied to fuel injection system components. Examples of the fuel injection system components applied with an extremely high stress include main unit of rail pressure accumulator of Diesel commonrail, pump cylinder, injector lower body, injector orifice and injector nozzle body (detailed later).

The free-cutting steel of the present invention can preferably be used in particular to the fuel injection system component having a joint hole. Many of the fuel injection components have joint holes, and portions in the vicinity of the joint holes tend to cause fatigue failure under repetitive application of high stress. The free-cutting steel of the present invention are preferably applicable even to such fuel injection system components having the joint holes highly causative of fatigue failure, by virtue of its large fatigue strength.

The free-cutting steel of the present invention also makes it possible to successfully machine the fuel injection system component in need of a long-and-narrow hole, because it uses Bi as a machinability-improving element. Machining is generally proceeded using a machining oil for the purpose of improving lubrication property of the cutting edge, wherein machining of the long-and-narrow hole may not be successful because the oil cannot reach the cutting edge which went deep inside the hole. However, Bi having a relatively low melting point (283° C.) can melt at machining temperature and become a liquid at the cutting edge, so that the melted Bi can raise the lubricating performance even in a portion deep inside the hole where the oil cannot reach, and makes it possible to proceed successful machining.

DESCRIPTION OF THE PREFERRED EMBODIMENT

The following paragraphs will explain embodiments of the present invention referring to the attached drawings.

The fuel injection system component of the present invention, or the fuel injection system component using the free-cutting steel of the present invention, can be configured as those for a commonrail-type fuel injection system publicly known as a fuel injection system for Diesel engine. The commonrail-type fuel injection system is configured so that a high-pressure fuel fed under pressure by an unillustrated fuel supply pump is accumulated in a commonrail 3 (see FIG. 7), and is dividedly fed also to an injector 2 (typically electromagnetic fuel injection valve: see FIG. 8) mounted on the individual cylinders of the engine, so as to supply, by injection, the high-pressure fuel from the injectors of the individual cylinders into the individual cylinders of the engine according to a predetermined timing.

Figure 7:
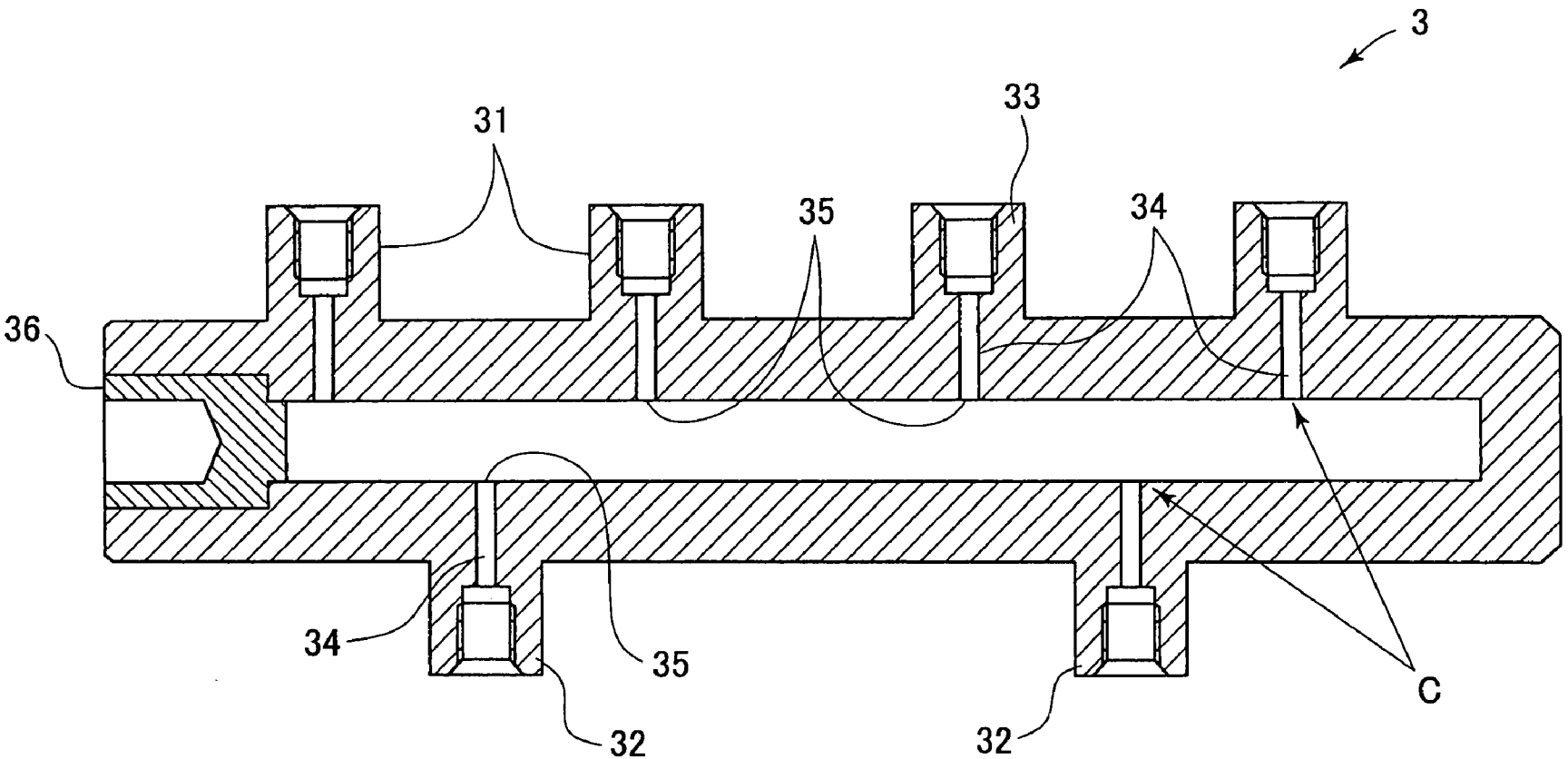
FIG. 7 is a schematic sectional view showing a fuel injection system component (injector) using the free-cutting steel of the present invention.

The commonrail 3 shown in FIG. 7 has pump-side pipe connection portions 32 to which high-pressure pipes led to the fuel supply pump are connected, and injector-side pipe connection portions 31 to which high-pressure pipes led to the injectors 2 (see FIG. 8) are connected, wherein each of the individual connection portions 31, 32 has a long-and-narrow throughhole 34 formed therein. A hollow portion of the main unit of the commonrail 3 and each throughhole 34 cross each other to thereby form a joint hole C.

Figure 8:
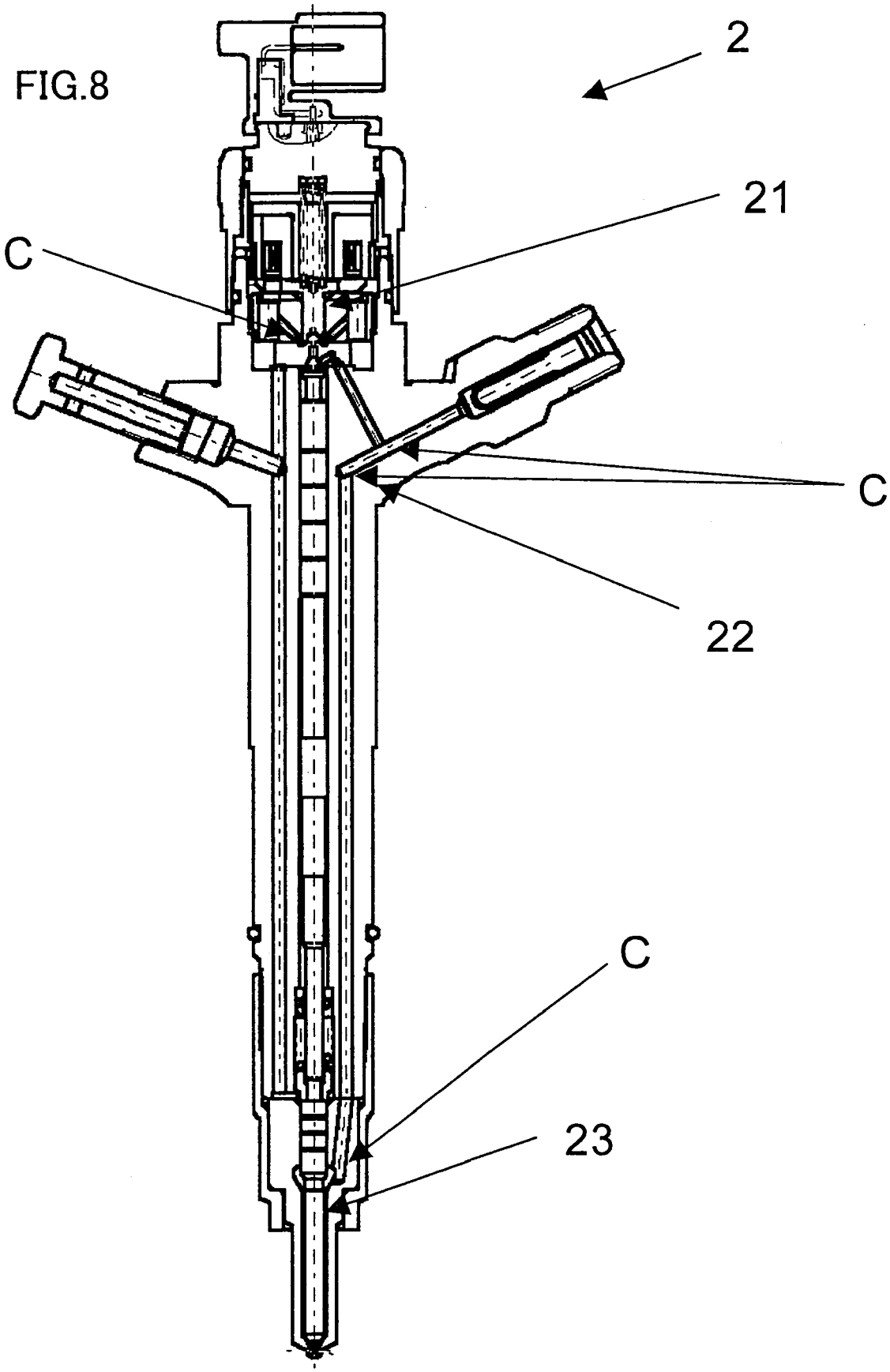
FIG. 8 is a schematic drawing showing a fuel injection system component (commonrail) using the free-cutting steel of the present invention.

The injector 2 shown in FIG. 8 has throughholes such as an orifice 21 through which the high-pressure fuel from the commonrail 3 (see FIG. 7) is introduced, and a nozzle 23 through which the high-pressure fuel is injected, wherein the throughholes respectively form the joint holes C.

Thus-configured commonrail 3 and injector 2 are continuously applied with a high pressure equivalent to an injection pressure of the fuel, and are therefore required to have a high fatigue strength endurable against it. These components respectively have a large number of joint holes C, wherein the portions around the joint holes C are highly causative of fatigue failure, and are therefore required to have a particularly high fatigue strength.

On the other hand, these components are also required to have a desirable machinability in view of successfully forming the long-and-narrow throughholes with complicated geometries.

The free-cutting steel of the present invention, having both of a high fatigue strength and a desirable machinability, is now successfully used as a material for these components.

The free-cutting steel of the present invention is applicable not only to the commonrail 3 and injector 2, but also to any other components of the commonrail-type fuel injection system. For example, the unillustrated fuel supply pump has a pressure application means such as cylinders for the purpose of supplying the fuel, wherein the free-cutting steel of the present invention can preferably be used also for this sort of portions. Also the pressure application means such as the cylinders have joint holes formed therein, and this supports adequacy of the free-cutting steel of the present invention.

The following experiments were carried out in order to confirm the effects of the present invention.

First, each steel ingot of 150 kg in weight, obtained by blending ingredients based on the compositions (% by mass) shown in Table 1, was melted in a high-frequency induction furnace, and was then processed by hot forging under heating at an appropriate temperature from 1,100° C. to 1,250° C., to thereby form round rods having an outer diameter of 55 mm (forging ratio: approximately 8). The round rods were further heated at 950° C. for one hour, air-cooled (normalize heat treatment), and subjected to the individual tests. Next, each steel ingot of 5 t in weight, obtained by blending ingredients based on the compositions (% by mass) shown in Table 2, was melted in an electric furnace, and was then processed by hot rolling under heating at an appropriate temperature from 1,100° C. to 1,250° C., to thereby form round rods having an outer diameter of 32 mm (forging ratio: approximately 8). The round rods were further heated at 950° C. for one hour, air-cooled (normalize heat treatment), and subjected to the individual tests.

TABLE 1

| Steel | | Chemical components, mass % | | | | | | | | | | | Solubility product Formula (1) | Size of inclusion $\sqrt{AREAmax}$ | | | |
|---|---|---|---|---|---|---|---|---|---|---|---|---|---|---|---|---|---|
| type | | C | Si | Mn | S | Cr | Mo | Al | Ti | O | N | Bi | | MnS + Bi | Bi | MnS | MnS |
| Lower limit | | 0.10 | 0.05 | 0.1 | 0.0005 | — | — | 0.010 | 0.0030 | — | 0.003 | 0.015 | −4.8 | ≦25 μm | ≦20 μm | ≦20 μm | Micronization |
| Upper limit | | 0.50 | 2.5 | 3.5 | 0.004 | 3.5 | 2.0 | 0.060 | 0.0100 | 0.0015 | 0.010 | 0.025 | −4.3 | | | | |
| Invented steel | 1 | 0.15 | 0.25 | 0.25 | 0.0029 | 1.02 | 0.15 | 0.019 | 0.0062 | 0.0005 | 0.007 | 0.019 | −4.4 | 19.1 | 16.5 | — | ○ |
| | 2 | 0.34 | 0.24 | 0.70 | 0.0011 | 1.2 | 0.17 | 0.003 | 0.0070 | 0.0011 | 0.004 | 0.021 | −4.7 | 17.5 | 17.5 | 9.3 | ○ |
| | 3 | 0.35 | 0.24 | 0.74 | 0.0021 | 1.00 | 0.20 | 0.025 | 0.0111 | 0.0009 | 0.006 | 0.020 | −4.3 | 17.1 | 16.9 | 11.9 | ○ |
| | 4 | 0.35 | 0.15 | 0.55 | 0.0039 | 1.01 | 0.10 | 0.015 | 0.0109 | 0.0005 | 0.003 | 0.018 | −4.7 | 20.0 | 16.6 | 16.4 | ○ |
| | 5 | 0.45 | 0.43 | 0.25 | 0.0019 | 0.11 | 0.01 | 0.029 | 0.0065 | 0.0009 | 0.004 | 0.020 | −4.7 | 20.3 | 16.9 | — | ○ |
| | 6 | 0.44 | 0.45 | 0.25 | 0.0030 | 0.07 | 0.01 | 0.024 | 0.0075 | 0.0007 | 0.005 | 0.018 | −4.5 | 19.0 | 16.5 | — | ○ |
| Comparative steel | 1 | 0.14 | 0.24 | 0.26 | 0.0151 | 0.98 | 0.20 | 0.025 | 0.0069 | 0.0007 | 0.007 | 0.020 | −4.4 | 62.2 | 16.7 | 60.0 | X |
| | 2 | 0.13 | 0.25 | 0.24 | 0.0097 | 0.99 | 0.21 | 0.020 | 0.0029 | 0.0007 | 0.014 | 0.022 | −4.4 | 55.0 | 16.6 | 48.0 | X |
| | 3 | 0.13 | 0.25 | 0.25 | 0.0014 | 0.99 | 0.03 | 0.033 | 0.0174 | 0.0012 | 0.015 | 0.004 | −3.6 | — | — | — | X |
| | 4 | 0.13 | 0.25 | 0.24 | 0.0032 | 1.00 | 0.02 | 0.033 | 0.0034 | 0.0011 | 0.020 | 0.002 | −4.2 | — | — | — | X |
| | 5 | 0.15 | 0.26 | 0.26 | 0.0071 | 1.01 | 0.10 | 0.024 | 0.0002 | 0.0005 | — | 0.019 | — | 44.8 | 17.2 | 38.0 | X |
| | 6 | 0.14 | 0.25 | 0.25 | 0.0011 | 1.00 | 0.15 | 0.025 | 0.0004 | 0.0007 | — | 0.022 | — | 21.4 | 18.4 | — | X |
| | 7 | 0.14 | 0.30 | 0.25 | 0.0088 | 1.01 | 0.19 | 0.021 | 0.0002 | 0.0008 | — | 0.021 | — | — | 17.2 | — | X |
| | 8 | 0.33 | 0.09 | 0.51 | 0.0181 | 0.98 | 0.07 | 0.022 | 0.0069 | 0.0007 | 0.005 | 0.020 | −4.6 | — | 17.2 | — | X |
| | 9 | 0.34 | 0.33 | 0.70 | 0.0029 | 1.01 | 0.01 | 0.025 | 0.0014 | 0.0007 | 0.006 | 0.019 | −5.1 | 24.0 | 19.0 | — | X |
| | 10 | 0.35 | 0.29 | 0.70 | 0.0017 | 1.10 | 0.02 | 0.027 | 0.0002 | 0.0006 | 0.006 | 0.018 | −6.0 | 25.1 | 18.1 | 14.6 | X |
| | 11 | 0.36 | 0.25 | 0.65 | 0.0040 | 1.01 | 0.01 | 0.024 | 0.0058 | 0.0007 | 0.015 | 0.018 | −4.1 | 27.9 | 18.6 | 22.8 | X |
| | 12 | 0.45 | 0.46 | 0.24 | 0.0074 | 0.07 | 0.01 | 0.024 | 0.0067 | 0.0006 | 0.009 | 0.020 | −4.3 | — | 17.4 | — | X |

TABLE 1-continued

| Steel type | Chemical components, mass % C | Si | Mn | S | Cr | Mo | Al | Ti | O | N | Bi | Solubility product Formula (1) | Size of inclusion √AREAmax MnS + Bi | Bi | MnS | MnS |
|---|---|---|---|---|---|---|---|---|---|---|---|---|---|---|---|---|
| 13 | 0.45 | 0.45 | 0.21 | 0.0074 | 0.15 | 0.01 | 0.023 | 0.0022 | 0.0006 | 0.019 | 0.019 | −4.4 | 45.0 | 17.4 | 31.1 | X |
| 14 | 0.46 | 0.45 | 0.23 | 0.0119 | 0.08 | 0.01 | 0.024 | 0.0002 | 0.0007 | 0.010 | 0.019 | −5.7 | — | 17.3 | — | X |
| 15 | 0.45 | 0.45 | 0.25 | 0.0120 | 0.09 | 0.01 | 0.025 | 0.0007 | 0.0006 | 0.008 | 0.022 | −5.3 | — | 17.2 | — | X |
| 16 | 0.47 | 0.46 | 0.27 | 0.0042 | 0.15 | 0.01 | 0.033 | 0.0004 | 0.0007 | 0.009 | 0.022 | −5.5 | 25.5 | 18.6 | — | X |
| 17 | 0.44 | 0.47 | 0.27 | 0.0028 | 0.11 | 0.03 | 0.036 | 0.0172 | 0.0010 | 0.005 | 0.002 | −4.2 | — | — | — | X |
| 18 | 0.45 | 0.46 | 0.27 | 0.0029 | 0.15 | 0.03 | 0.040 | 0.0098 | 0.0012 | 0.011 | 0.001 | −4.0 | — | — | — | X |
| 19 | 0.45 | 0.45 | 0.26 | 0.0029 | 0.10 | 0.03 | 0.027 | 0.0195 | 0.0009 | 0.010 | 0.004 | −3.7 | — | — | — | X |
| 20 | 0.45 | 0.45 | 0.27 | 0.0016 | 0.11 | 0.03 | 0.022 | 0.0040 | 0.0011 | 0.004 | 0.001 | −5.0 | — | — | — | X |

TABLE 2

| Steel type | | Chemical components, mass % C | Si | Mn | S | Cr | Mo | Al | Ti | O | N | Bi | Size of inclusion √AREAmax Bi | MnS |
|---|---|---|---|---|---|---|---|---|---|---|---|---|---|---|
| Lower limit | | 0.10 | 0.05 | 0.1 | 0.0005 | — | — | 0.010 | 0.0030 | — | 0.003 | 0.015 | ≦20 μm | Micronization |
| Upper limit | | 0.50 | 2.5 | 3.5 | 0.004 | 3.5 | 2.0 | 0.060 | 0.0100 | 0.0015 | 0.010 | 0.025 | | |
| Invented steel | 7 | 0.34 | 0.27 | 1.01 | 0.0040 | 0.94 | 0.15 | 0.033 | 0.0034 | 0.0011 | 0.008 | 0.013 | 10.0 | ○ |
| | 8 | 0.37 | 0.31 | 0.70 | 0.0030 | 1.21 | 0.19 | 0.055 | 0.0072 | 0.0010 | 0.003 | 0.019 | 16.3 | ○ |
| | 9 | 0.34 | 0.07 | 0.45 | 0.0006 | 0.99 | 0.03 | 0.040 | 0.0072 | 0.0007 | 0.005 | 0.020 | 17.2 | ○ |
| | 10 | 0.33 | 0.07 | 0.45 | 0.0025 | 2.00 | 0.05 | 0.049 | 0.0038 | 0.0006 | 0.009 | 0.011 | 10.5 | ○ |
| | 11 | 0.13 | 0.27 | 0.26 | 0.0030 | 0.70 | 0.03 | 0.030 | 0.0094 | 0.0014 | 0.005 | 0.015 | 16.6 | ○ |
| | 12 | 0.13 | 0.24 | 0.26 | 0.0020 | 0.99 | 0.03 | 0.029 | 0.0081 | 0.0009 | 0.005 | 0.015 | 16.7 | ○ |
| Comparative steel | 21 | 0.34 | 0.23 | 0.80 | 0.0040 | 0.99 | 0.03 | 0.034 | 0.0013 | 0.0011 | 0.010 | 0.008 | 6.6 | X |
| | 22 | 0.33 | 0.37 | 0.71 | 0.0040 | 0.98 | 0.03 | 0.030 | 0.0071 | 0.0008 | 0.001 | 0.057 | 30.5 | X |

(Estimation of Size of √AREAmax of Largest Inclusion Based on Texture Observation and Extreme Value Statistics)

A section of the round-rod specimen, normal to the axis thereof, was polished so as to obtain a specular surface, ten fields of view, respectively having an area of 0.1 $mm^2$, were randomly set on the polished section at positions which fall on the middle of the radius, and the texture was observed in the individual fields of view under an optical microscope (magnification: approximately ×400). An observed image in each field of view was analyzed, size of the largest inclusion was measured, and the obtained values were plotted on an extreme value population sheet, to thereby estimate size √AREAmax of the largest inclusion assuming a predicted area as 30,000 $mm^2$. It is to be noted that the inclusion is preliminarily confirmed as being a compound of MnS-base and/or Bi-base, by EPMA and X-ray diffractometry. Results are shown in Table 1 and Table 2.

As is clear from Table 1 and Table 2, all inclusions which reside in the steel textures were found to be micronized in the developed steels 1 to 12 having essential features of the present invention (more specifically, √AREAmax (MnS+Bi) was 25 μm or less, √AREAmax (MnS) was 20 μm or less, and √AREAmax (Bi) was 20 μm or less).

Figure 1:
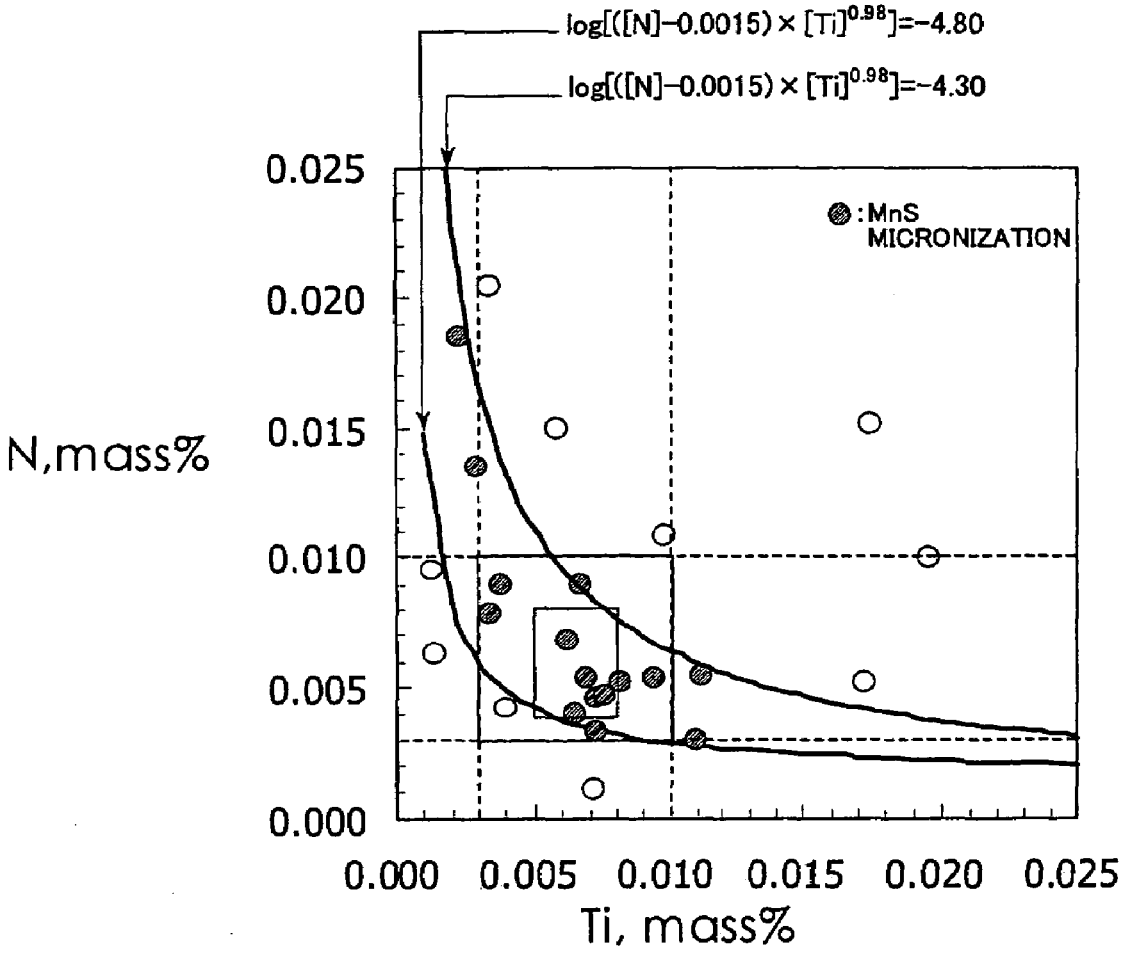
FIG. 1 is a graph showing occurrence of micronization of the sulfide-base inclusion depending on Ti and N contents.

FIG. 1 shows occurrence of micronization of the sulfide-base inclusion depending on Ti and N contents. Ti and N form TiN and thereby provide the nuclei of the sulfide-base inclusion. It is known from the drawing that the specimens having compositions which fall in the band-formed compositional range satisfying the formula (1) had the sulfide-base inclusion micronized therein. It was also found that TiN was not produced in a compositional range deviated towards the left-downward direction from the band-formed compositional range, and that coarse TiN grains were produced in a compositional range deviated therefrom towards the right-upward direction.

Both of the Ti content and N content are limited in the ranges thereof based on the separate reasons for limitation as described in the above (a square compositional range in FIG. 1, wherein the inner square indicates a more preferable compositional range), so that the range claimed by the present invention falls in a portion where the square compositional range and the band-formed compositional range overlap.

Figure 2:
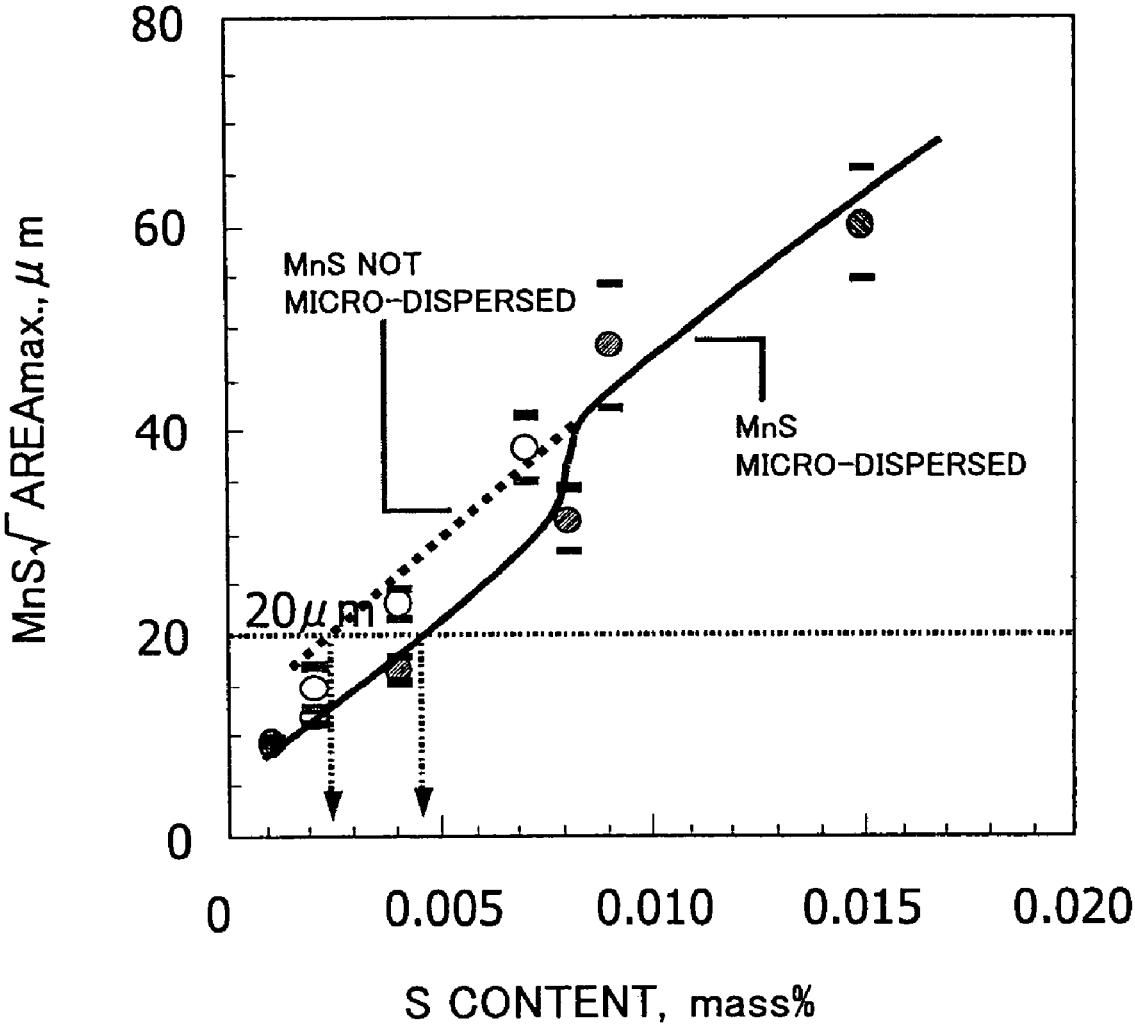
FIG. 2 is a graph showing S content dependence of maximum diameter [$\sqrt{}$AREAmax (MnS)] of the sulfide-base inclusion.

Next, S content dependence of the maximum diameter [√AREAmax (MnS)] of the sulfide-base inclusion is shown in FIG. 2. It is known that the embodiment having the sulfide-base inclusion micro-dispersed therein by producing TiN was successful in obtaining the effect of micro-dispersion in a range of the S content of 0.008% or less by mass or around. On the other hand, the comparative example having no measure for the micro-dispersion showed a nearly proportional relation between the S content and √AREAmax (MnS). It is to be noted that the embodiment showed a sharp increase in √AREAmax (MnS) at around a S content of 0.008% by mass, and a succeeding overlap in a higher range of S content with the straight line expressing the comparative example. This is possibly because an excessive S content starts to produce coarse sulfide-base inclusion without using TiN nuclei.

Comparison between the embodiment and the comparative example reveals that the comparative example can typically contain S only in an amount of as much as 0.0024% by mass when the upper limit of √AREAmax (MnS) is set to 20 μm, whereas the embodiment can contain S in an amount of approximately twice as much as 0.0046% by mass. As is obvious from the above, the embodiment, having the sulfide-base inclusion micro-dispersed therein by producing TiN, is successful in further raising the S content while keeping a micronized state of the sulfide-base inclusion, and this consequently improves the machinability.

Figure 3:
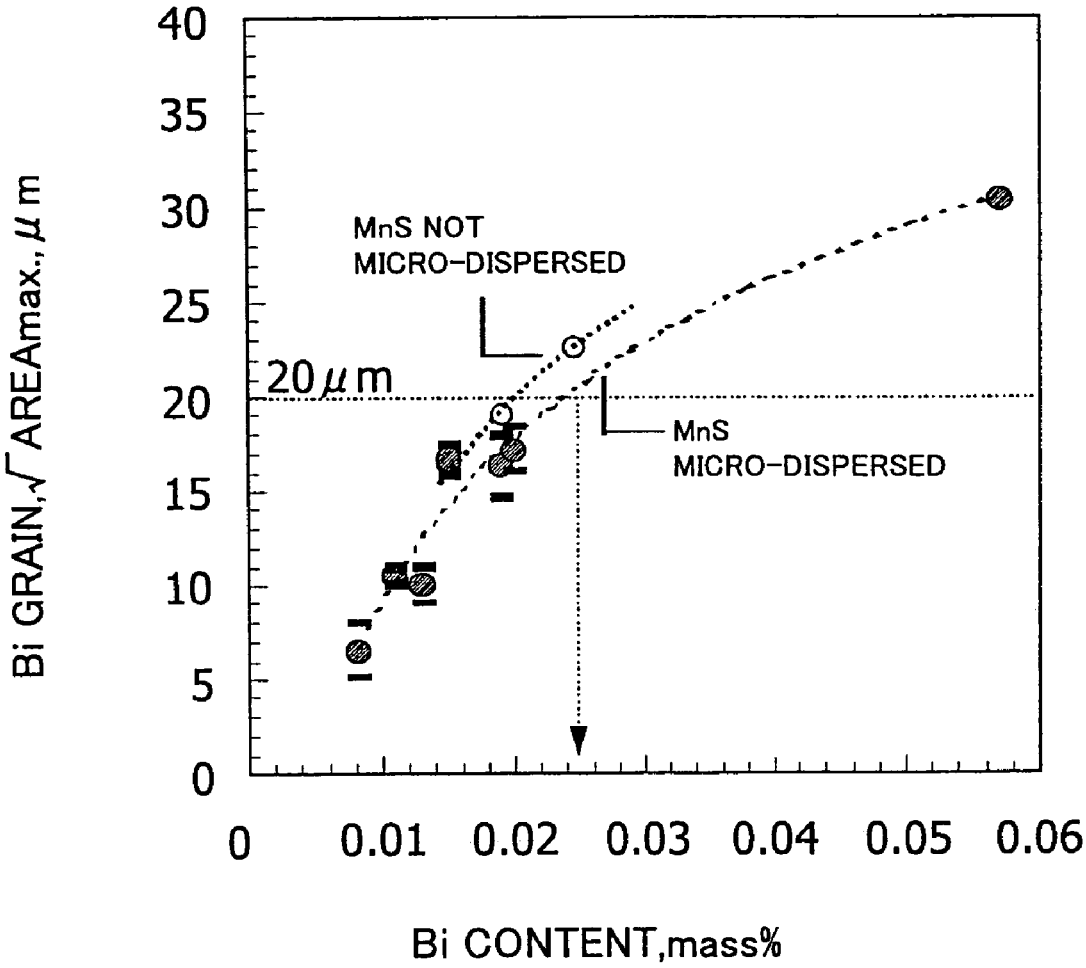
FIG. 3 is a graph showing Bi content dependence of maximum diameter [$\sqrt{}$AREAmax (Bi)] of the Bi metal inclusion.

Next, Bi content dependence of the maximum diameter [$\sqrt{}$AREAmax (Bi)] of the Bi metal inclusion is shown in FIG. 3. Similarly to the case shown in FIG. 2, comparison between the embodiment and the comparative example reveals that the comparative example can typically contain Bi only in an amount of as much as 0.020% by mass when the upper limit of $\sqrt{}$AREAmax (Bi) is set to 20 μm, whereas the embodiment can contain Bi in a larger amount of as much as 0.025% by mass. It is known from the above that the micro-dispersion of the sulfide-base inclusion with the aid of TiN also contributes to the micro-dispersion of the Bi metal inclusion. As is obvious from the above, the embodiment, having the sulfide-base inclusion micro-dispersed therein by producing TiN, is successful in further raising the Bi content while keeping micronized state of the sulfide-base inclusion, and this consequently improves the machinability.

Figure 4:
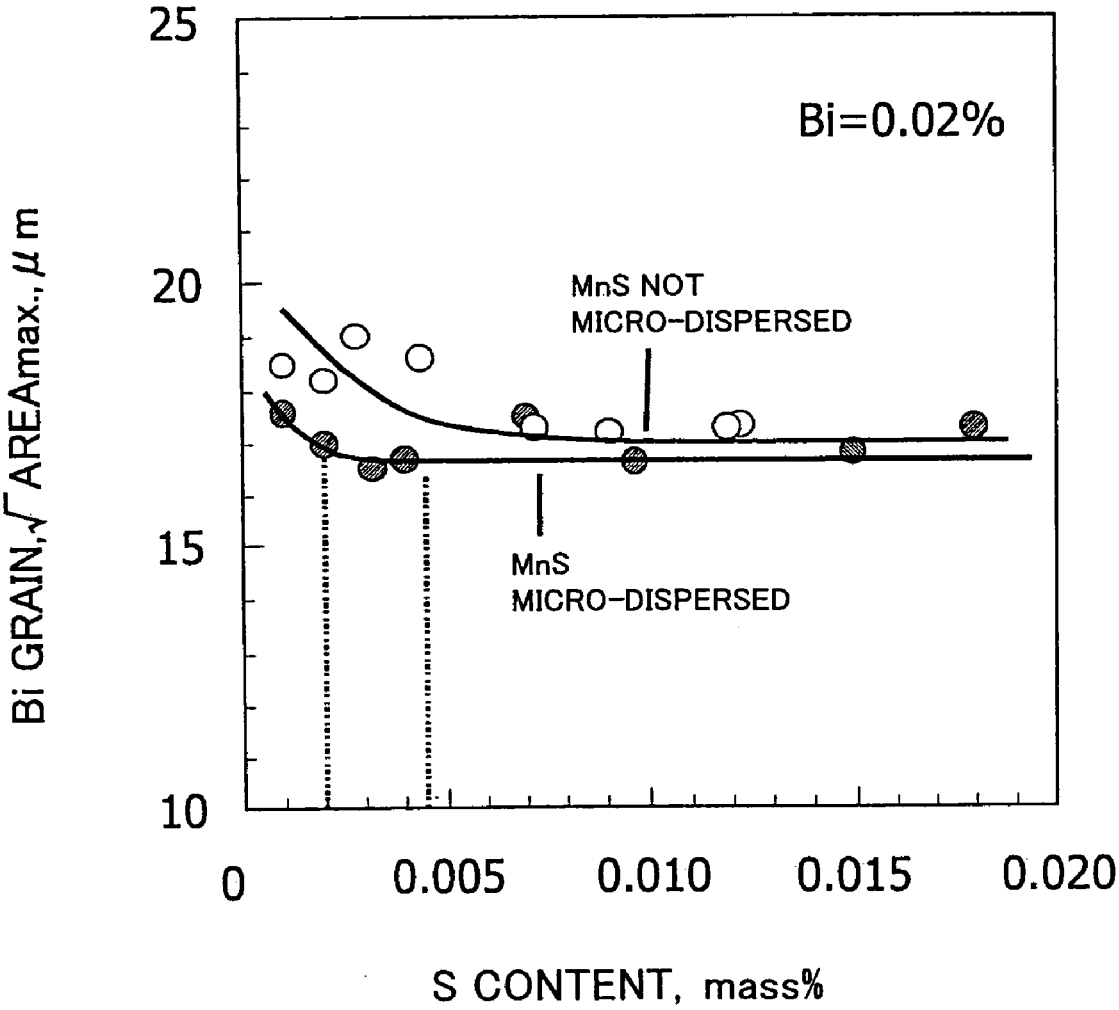
FIG. 4 is a graph showing S content dependence of maximum diameter [$\sqrt{}$AREAmax (Bi)] of the Bi metal inclusion.
Figure 5B:
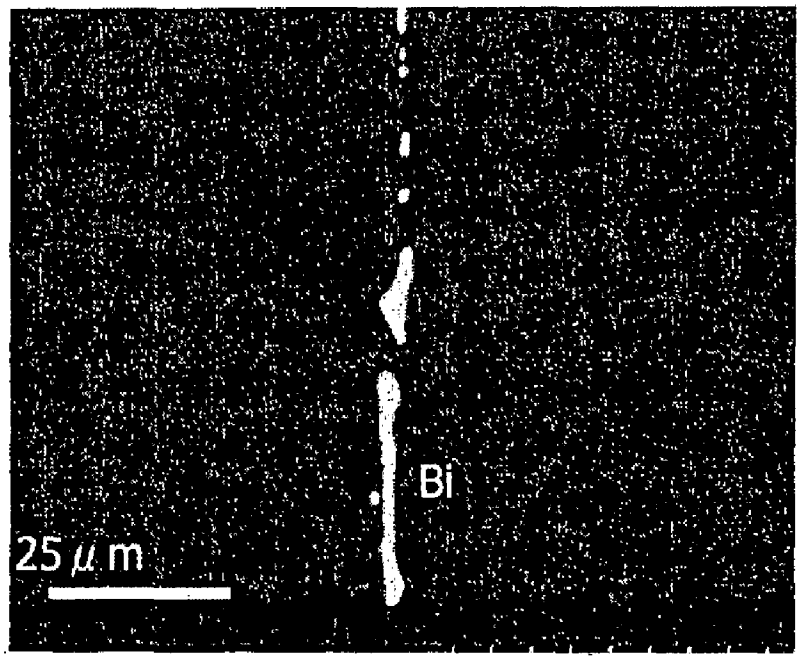
FIGS. 5A and 5B are photographs showing observation results of the inclusions.
Figure 5A:
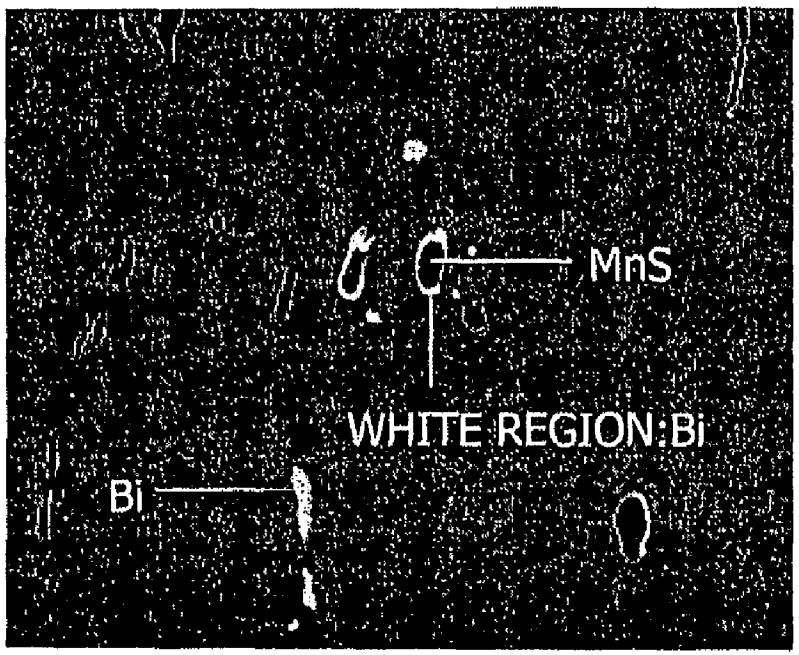

Next, S content dependence of the maximum diameter [$\sqrt{}$AREAmax (Bi)] of the Bi metal inclusion is shown in FIG. 4. The Bi content herein is fixed to 0.02% by mass. It is found that both specimens showed increase in the $\sqrt{}$AREAmax (Bi) on the lower-S-content side. The Bi metal inclusion tends to generate around the sulfide-base inclusion, and is micronized while being disconnected thereby. The increase in the $\sqrt{}$AREAmax (Bi) on the lower-S-content side is, therefore, possibly because the decrease in the sulfide-base inclusion promoted and enhanced production of the coarse Bi metal inclusion as a single entity. The embodiment, having the sulfide-base inclusion micro-dispersed therein by producing TiN, shows a lower S content where the $\sqrt{}$AREAmax (Bi) starts to increase in the lower-S-content side, as compared with the comparative example. This indicates that the micronization of the sulfide-base inclusion contributes to the micronization of the Bi metal inclusion. It is known from the above that the maximum diameter $\sqrt{}$AREAmax (Bi) of the Bi metal inclusion is controllable by controlling the amount and size of the sulfide-base inclusion.

Next, the machinability of the above-described specimens were evaluated.

The cutting test was carried out using a drill made of a high speed tool steel (JIS: SKH51) as a cutting tool, and using a vertical machining center, under the conditions listed below:

tool geometry: 5 mm in nominal diameter;

cutting speed: 30 m/min;

feed per revolution: 0.1 mm;

depth of hole: 15 mm; and cutting oil: water-soluble oil.

The evaluation was made in terms of cutting distance before an average amount of wear of the corner reached 100 μm.

Figure 6:
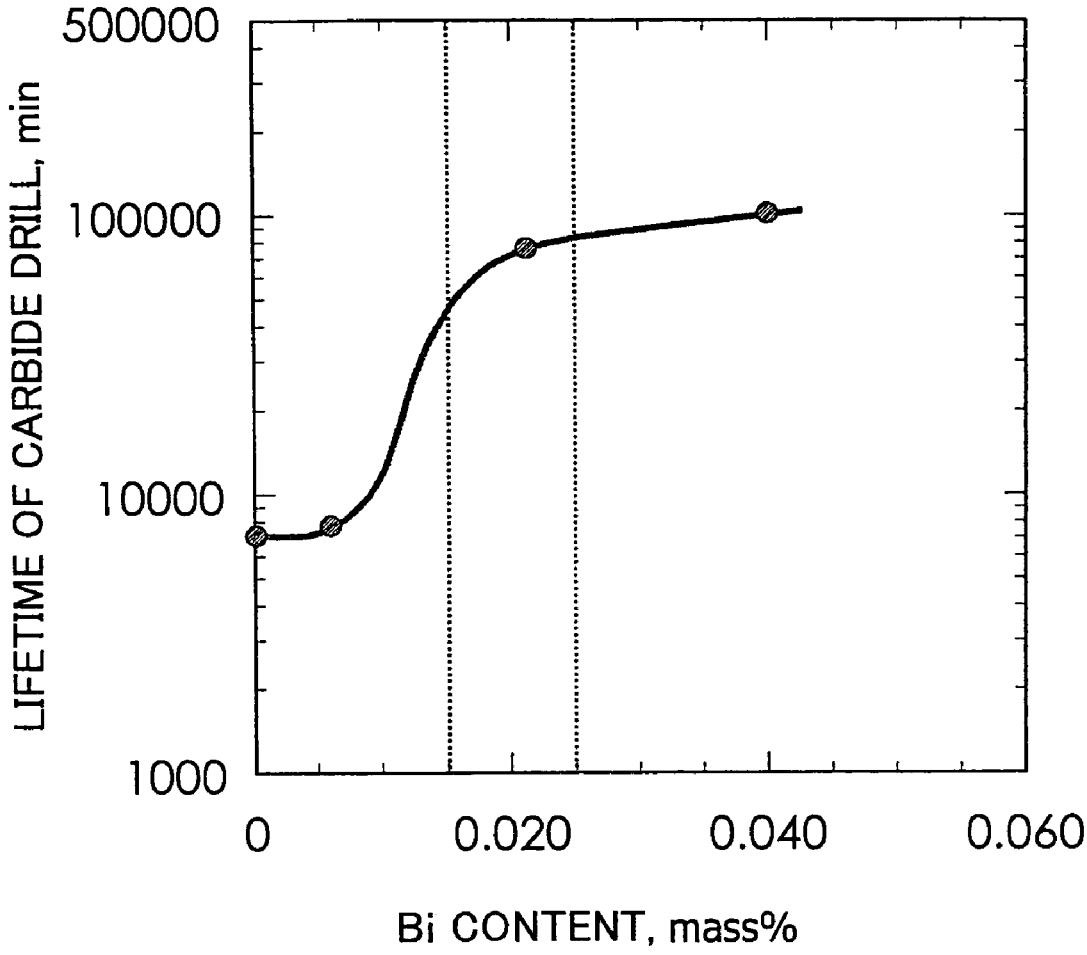
FIG. 6 is a graph showing results of machinability evaluation.

Results of the evaluation of machinability were shown in FIG. 6. It is known from the graph that the Bi content less than 0.015% by mass or less is unsuccessful in achieving a desirable machinability, whereas the Bi content not less than 0.015% by mass results in a large increase in the machinability. The effect of improving the machinability will, however, soon saturate, so that the upper limit of the Bi content is determined taking the above-described maximum diameters $\sqrt{}$AREAmax of the inclusions into consideration.

Referring now back, for example, to the graph showing the Bi content dependence of $\sqrt{}$AREAmax (Bi) shown in FIG. 3, the $\sqrt{}$AREAmax (Bi) has a value of 20 μm corresponding to a Bi content of 0.025% by mass, so that this value can be adopted as the upper limit of the Bi content.

Next, four types of developed steels (a) to (d) were manufactured while varying the rate of addition of Bi. Methods of manufacturing are similar to those described in the above. After the manufacture, Bi contents were examined for each developed steels. Results are shown in Table 3.

TABLE 3

| | Rate of addition of Bi (kg/min) | Yield of Bi (%) |
|---|---|---|
| (a) | 0.02 | 42% |
| (b) | 0.07 | 76% |
| (c) | 0.18 | 73% |
| (d) | 0.26 | 52% |

It is known from Table 3 that the yield of Bi was desirable when the rate of addition of Bi falls within a range from 0.05 kg per minute and per ton of molten steel to 0.20 kg per minute and per ton of molten steel, both ends inclusive, as compared with the rates outside the above-described range.

As is obvious from the above, the present invention made it possible to obtain a free-cutting steel suppressing production of coarse inclusion and having a high fatigue strength and a desirable machinability.

What is claimed is:

1. A free-cutting steel consisting essentially of, in % by mass, C: 0.1-0.5%, Si: 0.05-2.5%, Mn: 0.1-3.5%, S: 0.0005-0.004%, Al: 0.01-0.06% Ti: 0.003-0.01%, O: up to 0.0015%, N: 0.003-0.01%, Bi: 0.015-0.025%, and the balance of Fe and inevitable impurities, wherein the formula (1) below is satisfied:

$$-4.8 \leqq \log(([N]-0.0015)\times[Ti]^{0.98}) \leqq -4.3 \qquad \text{formula (1);}$$

wherein these inclusions reside in the steel texture:

a composite inclusion, in which a sulfide-base inclusion and a Bi metal inclusion are hybridized, has a maximum diameter $\sqrt{}$AREAmax (MnS+Bi), estimated by the extreme value statistics, of 25 μm or less;

the sulfide-base inclusion as a single entity has a maximum diameter $\sqrt{}$AREAmax (MnS), estimated by the extreme value statistics, of 20 μm or less; and the Bi metal inclusion as a single entity has a maximum diameter $\sqrt{}$AREAmax (Bi), estimated by the extreme value statistics, of 20 μm or less.

2. The free-cutting steel as claimed in claim 1, wherein the steel further contains one or both of Cr: up to 3.5%, and Mo: up to 2%.

3. A method of manufacturing the free-cutting steel as claimed in claim 1, wherein a Ti addition step for adding Ti, and a Bi addition step for adding Bi are carried out in this order, while keeping N concentration in a molten steel at 100 ppm or below.

4. A method of manufacturing the free-cutting steel as claimed in claim 2, wherein a Ti addition step for adding Ti, and a Bi addition step for adding Bi are carried out in this order, while keeping N concentration in a molten steel at 100 ppm or below.

5. The method of manufacturing the free-cutting steel as claimed in claim 3, wherein said Bi addition step is carried out so as to add Bi at a rate of addition of 0.05 kg per minute and per ton of molten steel to 0.20 kg per minute and per ton of molten steel, both ends inclusive.

6. The method of manufacturing the free-cutting steel as claimed in claim 4, wherein said Bi addition step is carried out so as to add Bi at a rate of addition of 0.05 kg per minute and per ton of molten steel to 0.20 kg per minute and per ton of molten steel, both ends inclusive.

7. A fuel injection system component composed of the free-cutting steel as claimed in claim 1.

8. A fuel injection system component composed of the free-cutting steel as claimed in claim 2.

9. A fuel injection system component composed of the free-cutting steel as claimed in claim 1, having a joint hole.

10. A fuel injection system component composed of the free-cutting steel as claimed in claim 2, having a joint hole.

* * * * *